US005299371A

United States Patent [19]

Haberstroh

[11] Patent Number: 5,299,371

[45] Date of Patent: Apr. 5, 1994

[54] BELT TRANSPORT SYSTEM INCLUDING DOG-EAR REMOVING ELEMENTS

[75] Inventor: Markus Haberstroh, Landsberg/L., Fed. Rep. of Germany

[73] Assignee: GAO Gesellschaft fur Automation und Organisation mbH, Fed. Rep. of Germany

[21] Appl. No.: 863,046

[22] Filed: Apr. 3, 1992

[30] Foreign Application Priority Data

Apr. 4, 1991 [DE] Fed. Rep. of Germany ..... 4110931

[51] Int. Cl.[5] ..... D06C 3/00; B65H 5/38

[52] U.S. Cl. ..... 38/9; 38/143; 271/272; 271/188

[58] Field of Search ..... 38/1 R, 1 B, 7, 8, 9, 38/10, 11, 44, 45, 47, 64, 69, 70, 71, 143, 144; 493/937; 270/10, 12; 198/392, 394, 395; 226/6, 10, 183, 196; 271/2, 3, 6, 7, 8.1, 69, 19, 34, 188, 264, 272

[56] References Cited

U.S. PATENT DOCUMENTS

| | | | |
|---|---|---|---|
| 1,357,644 | 11/1920 | Leonard | 271/8.1 |
| 1,912,724 | 6/1933 | Remington | 38/8 |
| 3,027,939 | 4/1962 | Dumas | 38/9 X |
| 3,426,558 | 2/1969 | Schmid | 38/143 X |
| 3,470,636 | 10/1969 | Withorn | 38/143 |
| 3,758,208 | 9/1973 | Robnolte | 271/3 X |
| 3,807,068 | 4/1974 | Ross | 38/143 |
| 3,963,339 | 6/1976 | Taylor et al. | 271/34 X |
| 4,197,621 | 4/1980 | Mair | 38/143 X |
| 4,614,334 | 9/1986 | Hemmi et al. | 271/8.1 |
| 5,046,272 | 9/1991 | Vogt et al. | 38/1 R X |

FOREIGN PATENT DOCUMENTS

| | | |
|---|---|---|
| 2729968 | 1/1978 | Fed. Rep. of Germany . |
| 2729830 | 1/1979 | Fed. Rep. of Germany . |
| 63-230467 | 9/1988 | Japan . |

*Primary Examiner*—Clifford D. Crowder
*Assistant Examiner*—Ismael Izaguirre
*Attorney, Agent, or Firm*—Bacon & Thomas

[57] ABSTRACT

A belt transport system for conveying thin sheet material, in which the sheet material is engaged by one side of a conveyor belt and one side of at least one baffle plate and conveyed in a clamped state through a clamping area. The system includes smoothing elements having smoothing surfaces disposed on the opposite side of the belt from the sheet side, the smoothing elements being disposed in such a way that bent parts or dog-ears of the sheet material protruding beyond the conveyor belt to its opposite side run into the smoothing element during transport and are thereby urged away from the clamping area of the belt.

4 Claims, 5 Drawing Sheets

BELT TRANSPORT SYSTEM INCLUDING DOG-EAR REMOVING ELEMENTS

BACKGROUND OF THE INVENTION

FIELD OF THE INVENTION

The present invention relates to a belt transport system for conveying sheet material without damaging the material despite the presence of bent parts or dog-ears.

DESCRIPTION OF RELATED ART

Belt transport systems for conveying sheet material are known in many different embodiments. For example, DE-OS 27 29 830 mentions such a transport system for conveying vouchers, bank notes or the like comprising a plurality of parallel-running round belts. The round belts are guided and driven over pairs of conveyor rollers. The conveyor belts are positioned relative to each other in such a way that the sheet material to be conveyed can be clamped and fixed between the belts and thus conveyed. The transport system is divided into a plurality of transport sections in which the conveyor belts designed as endless belts circulate. At the beginning and at the end of each transport section there are deflection rollers over which the endless belts are returned.

The transport of the sheet material clamped between the belts is relatively unproblematic if the sheets are in a good state of conservation, i.e. smooth and undamaged. If the state of conservation is poor, in particular if there are dog-ears or tears, however, there is a danger that parts of the sheet material might be bent out of the normal plane of transport so far behind the conveyor belts that they are clamped between the conveyor belts and the conveyor rollers during transport. If this happens in the area of the deflection rollers, for example, or in areas where the moving direction of the endless belts deviates from the direction of transport of the sheet material, at least the part of the sheet material clamped between the conveyor roller and the belt is forced out of the intended direction of transport into the moving direction of the conveyor belt. If technical measures are provided to ensure that the sheet material is held in the intended direction of transport despite the belt deflection, e.g. by suitable baffle plates, either the clamped part of the sheet is torn off or the sheet is drawn between the conveyor roller and the baffle plate in such a way as to clog the transport path and thus impair the functioning of the transport system. If no baffle plates or the like are provided in the deflection area the clamped sheet follows the moving direction of the belt and is thus removed from the transport path, which should also be avoided.

It is extremely difficult technically to eliminate dog-ears during transport. German patent no. 27 29 968, for example, describes such an apparatus for flattening bent corners on paper vouchers. The solution to this problem is seen to be to guide the voucher into a slot-shaped gap whose clear span only slightly exceeds the thickness of the voucher and whose run-in face extends at an acute angle to the direction of transport. The specification of the invention indicates that the form of the faces of the gap is supposed to fold back the dog-ear while the document is drawn through the gap.

One will easily understand that it always causes problems to thread the voucher into the gap when the leading edge of the voucher does not extend exactly perpendicular, i.e. whenever the voucher is poorly conserved.

But even if the voucher is correctly introduced there is a danger of the dog-ear being sheared off when the document passes through, this becoming increasingly probable at higher transport speeds.

SUMMARY OF THE INVENTION

The invention is therefore based on the problem of proposing a belt transport system having means for removing bent parts of the sheet material from the area of the belts at least far enough to prevent clamping between the conveyor roller and the belt, without damaging the sheet material.

This problem is solved according to the invention by means of smoothing elements disposed upstream of an end of a particular transport section in which the sheet material is clamped between the conveyor roller and the belt to transport the sheet material, the smoothing elements having grooves in a first surface which at least partly embrace the belts and at least one smoothing surface which, when engaged by a dog-ear, urges the dog-ear away from the transport section.

It proves to be particularly advantageous that the inventive measures are applicable regardless of the state of conservation of the sheet material. Since the smoothing elements are associated with the individual conveyor belts and are also effective on both sides of the belt in special embodiments, one can take care of not only bent corner areas but also dog-ears in the inner area of the edges, i.e. in the area of tears. This makes it possible to use the smoothing elements successfully in multibelt systems as well. The function of the smoothing elements is also ensured at high transport speeds without damage to the sheet material. Furthermore, the production of the elements is extremely inexpensive and they can also be subsequently integrated into existing transport systems.

BRIEF DESCRIPTION OF THE DRAWINGS

In the following, various embodiments of the invention shall be described by way of example with reference to the drawing, in which.

DETAILED DESCRIPTION OF THE PREFERRED EMBODIMENTS

Figure 1:
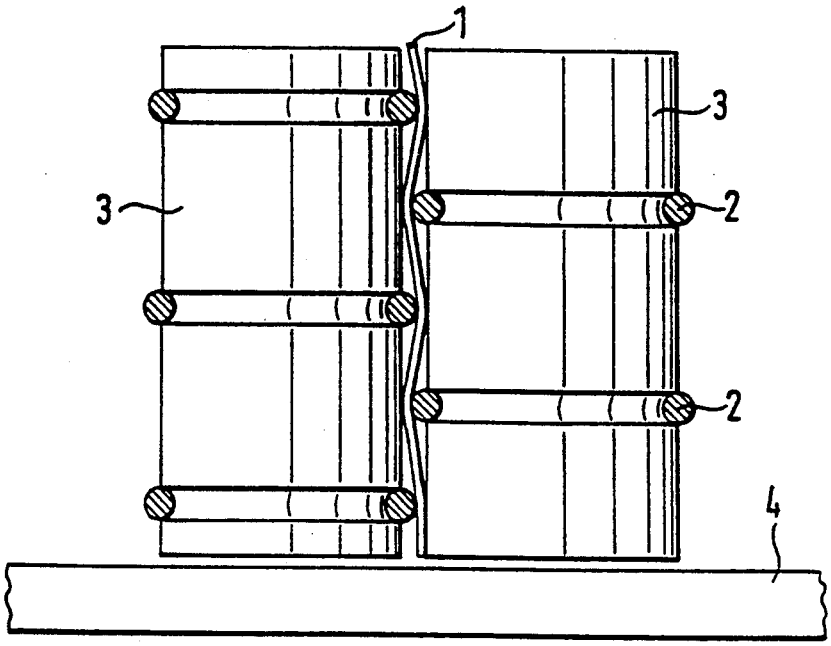
FIG. 1 shows a belt transport system with sheet material to be conveyed in a sectional view.

FIG. 1 shows a belt transport system in cross section, with a sheet 1 being conveyed squeezed in between conveyor belts 2. Conveyor belts 2 are guided by conveyor rollers 3. The latter are in turn fastened to a mounting plate 4.

Figure 2:
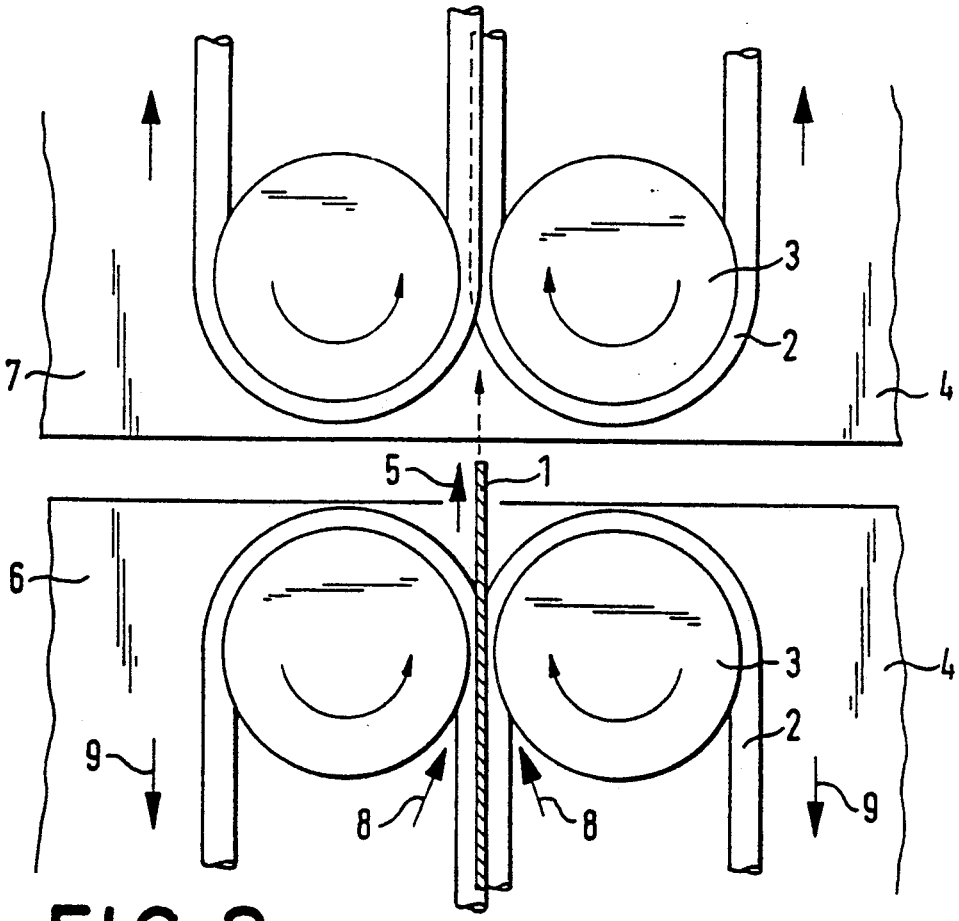
FIG. 2 shows the transition between two transport sections from the top.

FIG. 2 shows a top view of part of the transport system shown in FIG. 1. Sheet 1 to be conveyed is passed in direction of transport 5 from the end conveyor rollers of transport section 6 to the input conveyor rollers of transport section 7. The conveyor belts are deflected in the area of the particular pairs of conveyor rollers and returned to the opposite end of the particular transport section.

If a dog-ear protrudes beyond conveyor belt 2 in a sheet 1 in the form, for example, of a voucher approaching conveyor rollers 3 of transport section 6, there is a danger in funnel-shaped transitional areas 8 that this dog-ear might be clamped between conveyor roller 3 and belt 2 and thus held by the conveyor belt during the total wrap around the conveyor rollers. In this case the voucher is not conveyed to the conveyor rollers of following transport section 7 in intended direction of transport 5, but around the particular conveyor roller 3 in the moving direction of belts 2 shown by arrows 9. If baffle plates (not shown) are provided between transport sections 6 and 7 to ensure a clean transfer of the sheet material, the dog-ear clamped by conveyor belt 2 is either torn off, since the rest of the sheet material is forced into the planned direction of transport, or the sheet material is deformed in the area of the baffle plates in such a way as to prevent trouble-free further transport (jamming).

Figure 3:
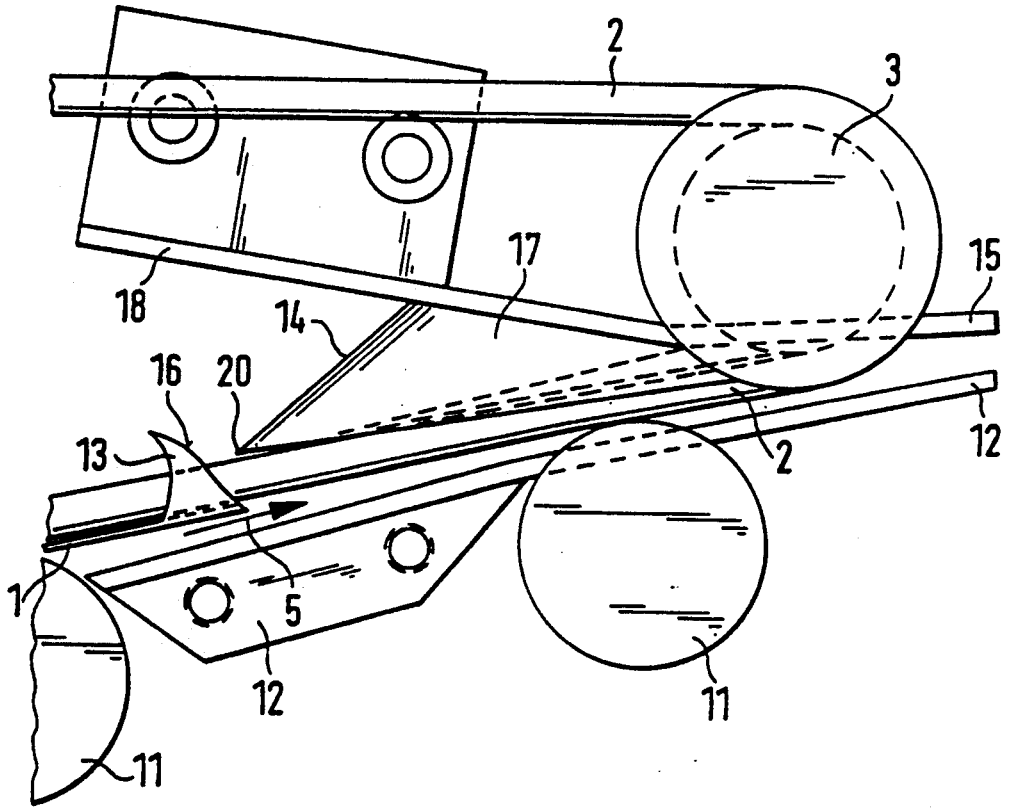
FIG. 3 shows a transport system area with a smoothing element.

FIG. 3 shows a detail of a further variant of a belt transport system wherein the conveyor belts are replaced on one side by conveyor rollers 11 and baffle plates 12. As in FIG. 2, conveyor belt 2 is deflected on conveyor roller 3 in FIG. 3. Transport material 1 is conveyed between conveyor roller 11 and conveyor belt 2 in the direction of arrow 5. In the present case sheet 1 has a dog-ear 13 which is bent so far behind conveyor belt 2 that it could be squeezed between the roller and the belt when reaching deflection roller 3 without any additional measures. To prevent clamping smoothing element 14 is provided. It is disposed on the back of belt 2 in such a way that the part of the sheet material protruding behind the conveyor belt, for example dog-ear 13, runs with leading edge 16 onto smoothing surface 17, thereby being urged upwardly, as on an inclined plane, so far that it is removed from the clamping area of conveyor belt 2 upon reaching conveyor roller 3. After the leading edge of the sheet material has been conveyed past conveyor roller 3 its faultless transfer to the following transport section is ensured by means of baffle plates 12 and 15.

Figure 5:
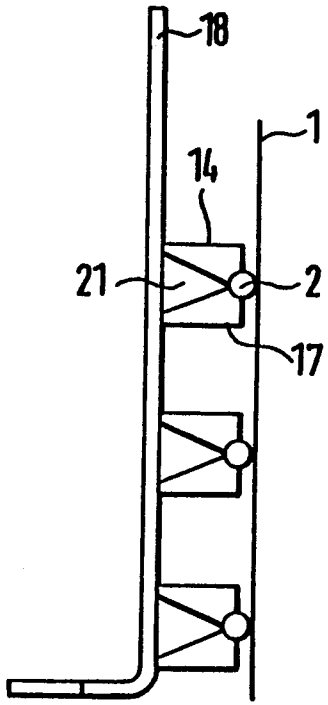
FIG. 5 shows a side view of the smoothing elements shown in FIG. 4, FIG. 6 and 6*a* through 6*d* show the smoothing element in various views.
Figure 4:
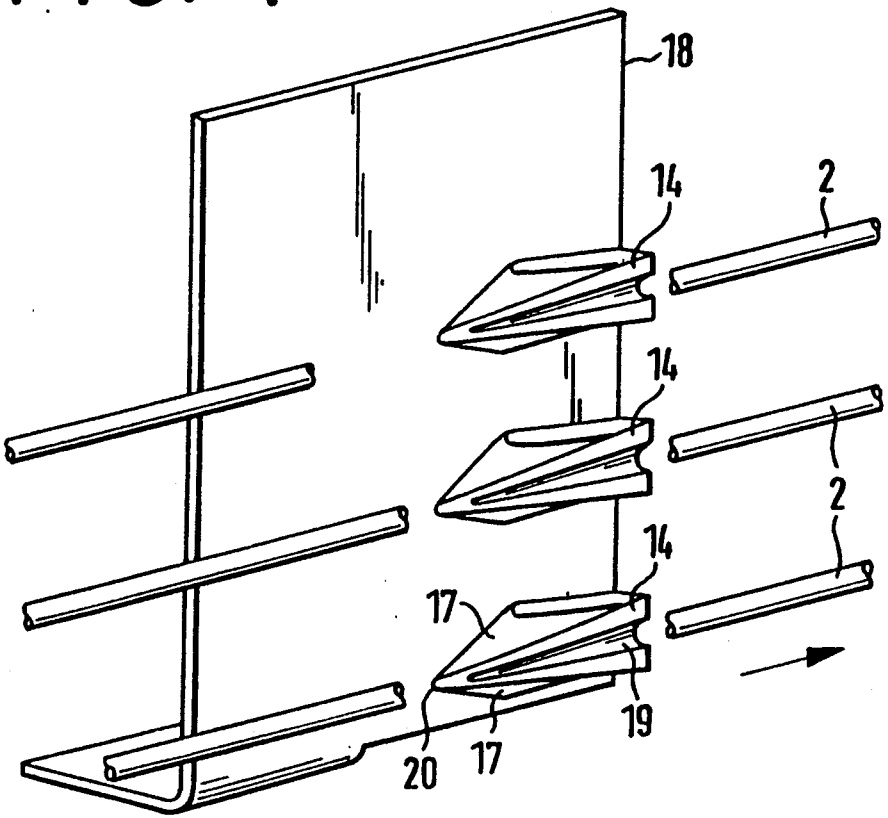
FIG. 4 shows a detail of three smoothing elements in a three-dimensional representation.

FIGS. 4 and 5 show three such smoothing elements fastened to a mounting plate 18. Smoothing elements 14 are each disposed on the back of belts 2 symmetrically to the belt. They have slide grooves 19 in which the belt runs past spaced as close as possible, and two smoothing surfaces 17 symmetrical to the longitudinal axis of the conveyor belt for urging dog-ears out of the rearward clamping area of the belt on both sides of the belt.

The assembly shown in FIG. 4 is expediently positioned, as in FIG. 3, shortly before deflection roller 3 so as to leave as little space as possible between deflection roller 3 and the smoothing element. A dog-ear 13 thus cannot be pushed behind the conveyor belt before reaching deflection roller 3. Since the conveyor belt dips into the smoothing element and therefore is even partly covered by the smoothing element in the critical area, direct contact is effectively avoided between the conveyor belt and the dog-ear.

Figure 6:
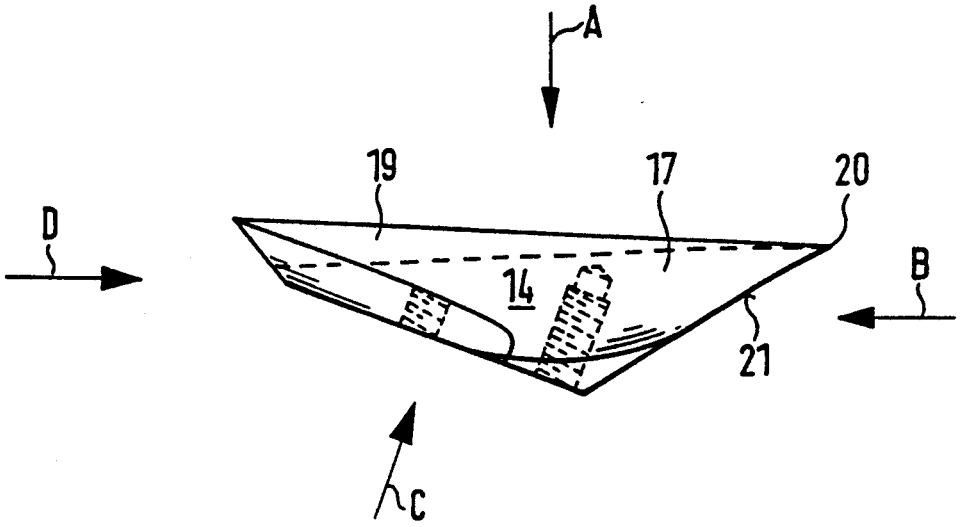
Figure 6A:
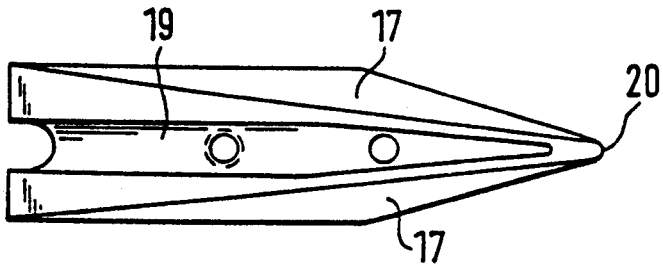
Figure 6B:
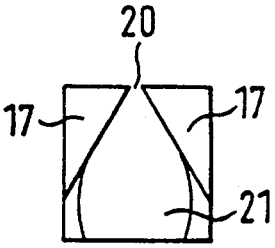
Figure 6C:
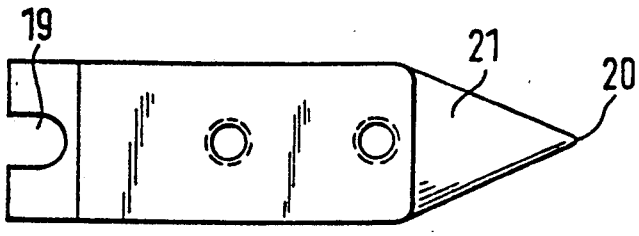
Figure 6D:
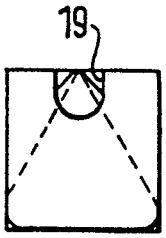

FIG. 6 shows the inventive smoothing element in various views. One can see that the smoothing element tapers to a point, regarded from the direction of transport in the case of application (see FIG. 4), with smoothing surfaces 17 and slide groove 19 extending along the element from apex 20. Slide groove 19 becomes ever deeper in the smoothing element starting at apex 20, so that the belt is embraced ever deeper by the smoothing element, regarded from apex 20. Smoothing surfaces 17 have a substantially triangular basic shape, extending parallel to the conveyor belt at a slightly rising acute angle with respect to the center line of conveyor belts 2.

Figure 7:
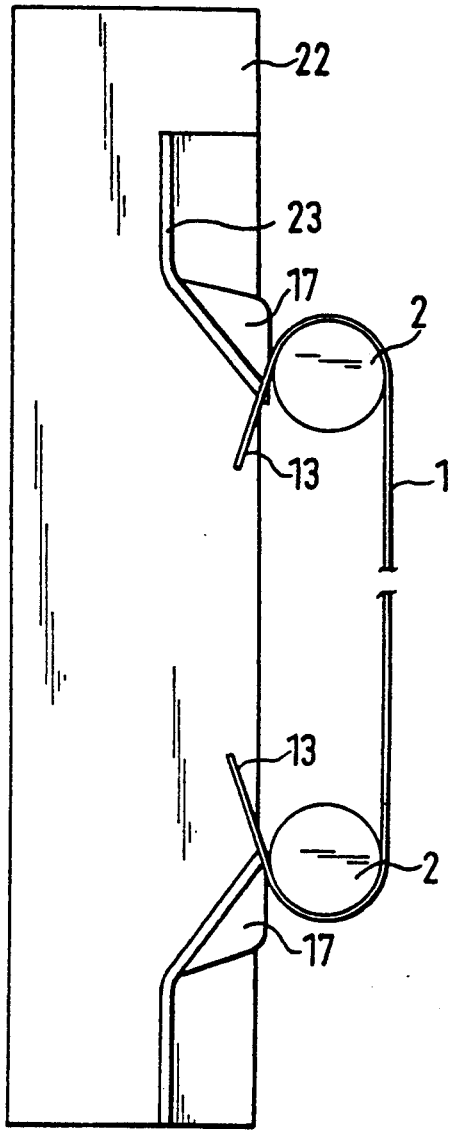
FIG. 7 shows a simplified embodiment of the inventive functional principle.

FIG. 7 shows an alternative embodiment of inventive smoothing element 14. In this case smoothing surfaces 17 are formed by accordingly bent smoothing angles 23 mounted on a mounting plate 22. Angles 23 are designed in such a way as to bend up dog-ears 13 engaging about the conveyor belt during transport along the inclined edge, thereby likewise urging the dog-ear out of the clamping area of conveyor belt 2. In the embodiment shown in FIG. 7, smoothing angles 23 act only on the dog-ears coming from one side of the belt. However, those skilled in the art will appreciate that an operation on both sides of a conveyor belt can be effected by a corresponding symmetrical structure, i.e. by providing two opposite smoothing surfaces for each conveyor belt as in FIG. 6. Such a symmetrically constructed smoothing angle 23 accordingly offers the same possibilities as smoothing element 14 shown in FIG. 6.

I claim:

1. A belt transport system for conveying thin sheet material in a predetermined direction, comprising a clamping area in which at least one transport belt is driven in said direction by means of conveyor rollers with the sheet material clamped between a side of a conveyor belt and at least one baffle plate; and at least one smoothing element disposed upstream of said clamping area relative to said direction; wherein said at least one smoothing element includes a groove situated in a first surface of the smoothing element through which the belt passes before being driven in the clamping area, and wherein said smoothing element includes a second surface, the second surface comprising a smoothing surface positioned so as to engage a dog-ear on the sheet material as the sheet material is conveyed by the belt past the smoothing element, the smoothing surface facing away from said side of the belt and thereby urging said dog-ear away from said clamping area.

2. A belt transport system as claimed in claim 1, further comprising a plurality of said transport belts, and wherein one of said smoothing elements is provided for each of said plurality of said transport belts.

3. A belt transport system as claimed in claim 1, wherein said smoothing surface is inclined such that said smoothing surface and a center axis of said belt define therebetween an angle whose vertex is on the upstream side of the smoothing surface relative to said direction.

4. A belt transport system as claimed in claim 3, wherein said smoothing element includes two of said smoothing surfaces, each forming an acute angle with respect to the center axis of said belt.

* * * * *